US005325640A

United States Patent [19]

Luedke et al.

[11] Patent Number: 5,325,640

[45] Date of Patent: Jul. 5, 1994

[54] FOLDING STAGE SYSTEM

[75] Inventors: Thomas J. Luedke, Apple Valley; Randy G. Aagaard, Richfield; Carl A. Niemi, Excelsior; Andrew J. Shea, Eden Prairie, all of Minn.

[73] Assignee: Sico Incorporated, Minneapolis, Minn.

[21] Appl. No.: 743,154

[22] Filed: Aug. 9, 1991

[51] Int. Cl.[5] ..... E04H 3/26; E04H 3/28

[52] U.S. Cl. ..... 52/9; 52/7; 52/8; 108/112; 108/116

[58] Field of Search ..... 52/7, 143, 8, 9; 108/112, 113, 114, 116

[56] References Cited

U.S. PATENT DOCUMENTS

| | | | |
|---|---|---|---|
| D. 304,499 | 11/1989 | Rogers et al. . | |
| D. 307,186 | 4/1990 | Rogers et al. . | |
| 2,978,754 | 4/1961 | Wilson . | |
| 3,080,833 | 3/1963 | Risdall | 108/112 |
| 3,351,029 | 11/1967 | Bue . | |
| 3,476,061 | 11/1969 | Takahashi | 108/112 |
| 3,999,491 | 12/1976 | Wilson . | |
| 4,026,221 | 5/1977 | Wilson et al. | 108/113 |
| 4,054,096 | 10/1977 | Wilson et al. | 108/113 |
| 4,074,636 | 2/1978 | Wilson . | |
| 4,104,835 | 8/1978 | Bardwick, III . | |
| 4,232,488 | 11/1980 | Hanley | 52/69 |
| 4,301,627 | 11/1981 | Wilson . | |
| 4,327,650 | 5/1982 | Bue | 108/113 |
| 4,570,751 | 2/1986 | Kleu | 108/112 |
| 4,638,604 | 1/1987 | Rogers et al. . | |
| 4,779,542 | 10/1988 | Staten et al. . | |
| 4,811,530 | 3/1989 | Eyerly . | |
| 4,843,792 | 7/1989 | Rogers et al. . | |
| 4,845,915 | 7/1989 | Rogers et al. . | |
| 4,863,126 | 9/1989 | Rogers et al. . | |
| 4,872,295 | 10/1989 | Fujita | 52/7 |
| 4,917,217 | 4/1990 | Rogers et al. . | |
| 4,934,113 | 6/1990 | Hall et al. . | |
| 4,949,649 | 8/1990 | Terres et al. . | |

FOREIGN PATENT DOCUMENTS

| | | |
|---|---|---|
| 1055079 | 5/1979 | Canada . |
| 2637215 | 7/1976 | Fed. Rep. of Germany . |
| 16090 | 6/1983 | Philippines . |
| 76343 | 5/1982 | Romania . |
| 1526323 | 7/1976 | United Kingdom . |

*Primary Examiner*—Carl D. Friedman
*Assistant Examiner*—Christopher T. Kent
*Attorney, Agent, or Firm*—Merchant, Gould, Smith, Edell, Welter & Schmidt

[57] ABSTRACT

An elevationally adjustable folding stage has a frame which folds along a center of the stage from a storage position to a use position. Stage panels form a stage surface and are reversible and interchangeable. The stage may also support additional panels between stages extending therefrom to form an extended stage surface. The stage has a roller assembly which lifts the stage up so that rollers engage the floor for rolling between storage and use locations. Connectors between the frame and the stage offer quick connection without additional pieces. Connectors also provide for inserting risers to raise the height of one panel of the stage relative to the other. In addition to the risers, multi-panel supporting bases may be used to support the panels extending from the edges of the stage between stages. The panels between the stages may be stored on the stage while in the use or folded position by hook members which rotate from a storage to a use position to retain the additional panels. Folding of the stage is assisted by a spring folding assist member which prevents closing of the stage and assists in the initial opening of the stage toward the folded position. Accidental folding of the stage is also prevented by a locking linkage and a spacing linkage which lock the stage in the use position to prevent accidental folding and also to maintain the stage in the use position when elevationally adjusting the stage panels.

18 Claims, 14 Drawing Sheets

FOLDING STAGE SYSTEM

BACKGROUND OF THE INVENTION

1. Field of the Invention

The present invention relates to the field of mobile elevationally-adjustable folding stages which also support panels placed between stages for an extended stage surface.

2. Description of the Prior Art

Folding stages are used for a variety of purposes to provide a temporary raised platform for use in schools, hotels, convention centers and other institutions wherein multiple use facilities require the capability of setting up temporary stages. Such stages are made up of individual stage structures which are positioned adjacent each other to form an extended stage surface or are positioned to support bridge panels between the stages to form an extended stage surface. When not in use, the individual stage structures may be folded to compact dimensions and stored along with the bridge panels. The stages typically have two stage surface members hinged together to provide for folding action, and have legs which either fold out of the way or remain vertical while the stage panels fold.

An example of such a folding stage is shown in U.S Pat. No. 4,949,649 to Terres et al. Although the stage shown in the Terres patent is very successful in providing efficient and useful folding stages, further improvements are still possible, particularly with regard to stages having expandable areas which also fold for storage. Folding stages require a lock so that the stage panels remain securely in place forming a continuous stage surface and so that the stages do not fold inadvertently. The center lock of the Terres patent requires a relatively complicated mechanism which is spring loaded and aligns between the two panels of the folding stage. The present invention provides for locking of the two sides of the stage at an accessible location with an inexpensive simple mechanism.

Previous folding stages have heretofore not provided for satisfactorily supporting bridging panels between the frameworks of the stages to form an extended stage surface. Extensible area stages have not provided for folding of the frameworks of each stage. In addition, there has been no storage for the bridging panels on the stages having a framework.

Portable stages often have wheel assemblies which can be pivoted about a frame member into engagement with the floor to lift the supporting legs off the floor so that the stage will roll. However the wheel assemblies are located near the ground with handles for rotating the wheel assemblies between positions also located near the ground. Actuation of the low handles requires bending over by workers attempting to engage or release the legs. The accessibility is limited as the handle is typically underneath the stage surface so that in addition to bending over, the worker must move underneath the stage panels to move the wheel assemblies between positions. Therefore, it is advantageous to provide wheel assemblies which provide a mechanical advantage and also provide for engaging and disengaging the wheels with the handle easily accessed in all positions.

Although prior folding stages are elevationally adjustable, prior stages have not provided for adjusting the height of one panel as a folding stage relative to the other panel. Such adjustment would provide for forming choral riser-type formations with a single folding stage.

Methods for attaching panels to the framework so that the panels may be easily attached or may be reversed heretofore have required connectors inserting through passages in the panels and which had loose separate top portions which were detachable from the stage and could be lost or misplaced. The connectors also require a groove in the stage panel passage to engage the connector for locking the panel into position.

It may be seen then, that there is a need for a folding stage which provides for reversible panels which are secured in an improved manner with no extra loose parts. It can also be seen that a stage is required which has easy access for locking and unlocking a stage into position and for engaging wheel assemblies. Storing and handling of stage panels supported between stage frames must be stored in an easy, economical fashion on the existing frameworks. Folding stages should also have the ability to adjust the height of one stage panel relative to an adjacent stage panel so that choral riser configurations may be achieved. The present invention addresses these as well as other problems associated with folding stages.

SUMMARY OF THE INVENTION

The present invention is directed to folding stages which may be used to set up temporary elevated platforms. The present invention has stage panels supported by a folding frame. The frame folds from a use position wherein the panels are horizontal and form a stage surface to a folded position wherein the frame takes up less area and the stage panels are substantially facing one another.

The present invention provides for connecting and removing stage panels from the framework and for reversing the panels. Connectors extend through openings in the stage panels to frictionally engage the openings to secure the panels in place. In addition, panels which bridge between the stages to form an extended stage surface may be stored on top of the panels of the stage with hook members which retain the panels. The hook members rotate out of view and underneath the stage panel when not used for retaining the extra bridging panels.

The connectors of the present invention also provide for supporting the bridging panels which form an extended stage surface between the stages off of two sides of the stage or supporting three panels adjacent a corner of the stage. By having supports with multi-connectors positioned thereon, the various panels may be supported between the stages.

The stage panels may also be elevated relative to one another on a single stage by inserting risers below the connectors. Various heights of risers may be inserted on top of the frame and below the connector to elevate one panel relative to another, thereby forming a choral riser type structure.

The stages fold between a use position wherein the panels are substantially horizontal and a storage position wherein the panels are substantially facing one another. When in the use position, the stage must be maintained so that it does not fold while in use from pressures at the edges of the stage. The present invention provides for a locking linkage extending between the legs underneath each panel to space the legs apart from one another. The locking linkage can be easily accessed and snapped into position with a worker's foot by stepping on the linkage and easily kicking out the linkage to disengage. The locking linkage works with a spacing linkage extending between one set of legs which maintains the distance between the legs so that the stage does not fold during elevational adjustment.

In addition to the locking linkage for maintaining the stage in the use position, the present invention provides or folding assistance. A spring-supported folding stanchion engages the stage during the final motion of folding to the use position. The folding stanchion acts as a cushioning device so that the weight of the stage does not slam the stage into the fully-open position. This prevents pinching of hands or fingers which may be caught between the folding members of the stage. The spring of the folding stanchion also provides constant force against the folding framework of the stage to aid in starting the motion of folding the stage to the storage position.

The present invention also provides roller assemblies which ease transporting of the stage between storage and use positions. Roller assemblies have rollers which can be raised and lowered to engage the floor. The roller assembly uses a pivoting linkage to pivot the rollers up and down from a position wherein they are fully lifted from the floor so that the legs of the stage engage the floor and a lowered position wherein the legs are lifted from the floor and the rollers engage the floor. A rotating handle which rotates from a storage position where it is hidden below the stage panels to a position where it is easily grasped provides mechanical advantage so that a single person can easily raise and lower the roller assemblies from the fully raised to fully lowered position.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

In the drawings, wherein like reference numerals designate corresponding elements throughout the several views.

DETAILED DESCRIPTION OF THE PREFERRED EMBODIMENT(S)

Figure 1:
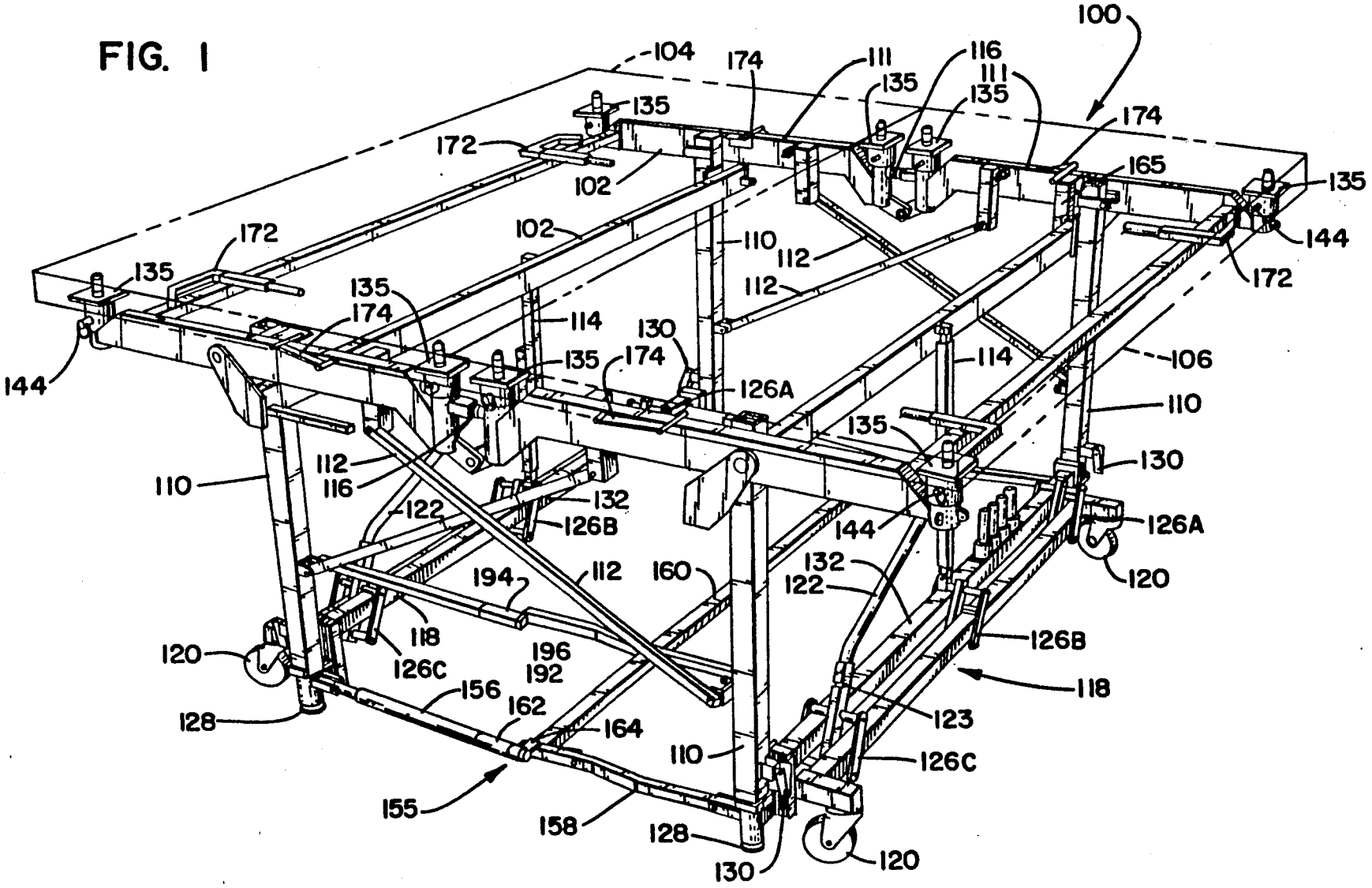
FIG. 1 shows a perspective view of an unfolded stage according to the principles of the present invention.
Figure 2:
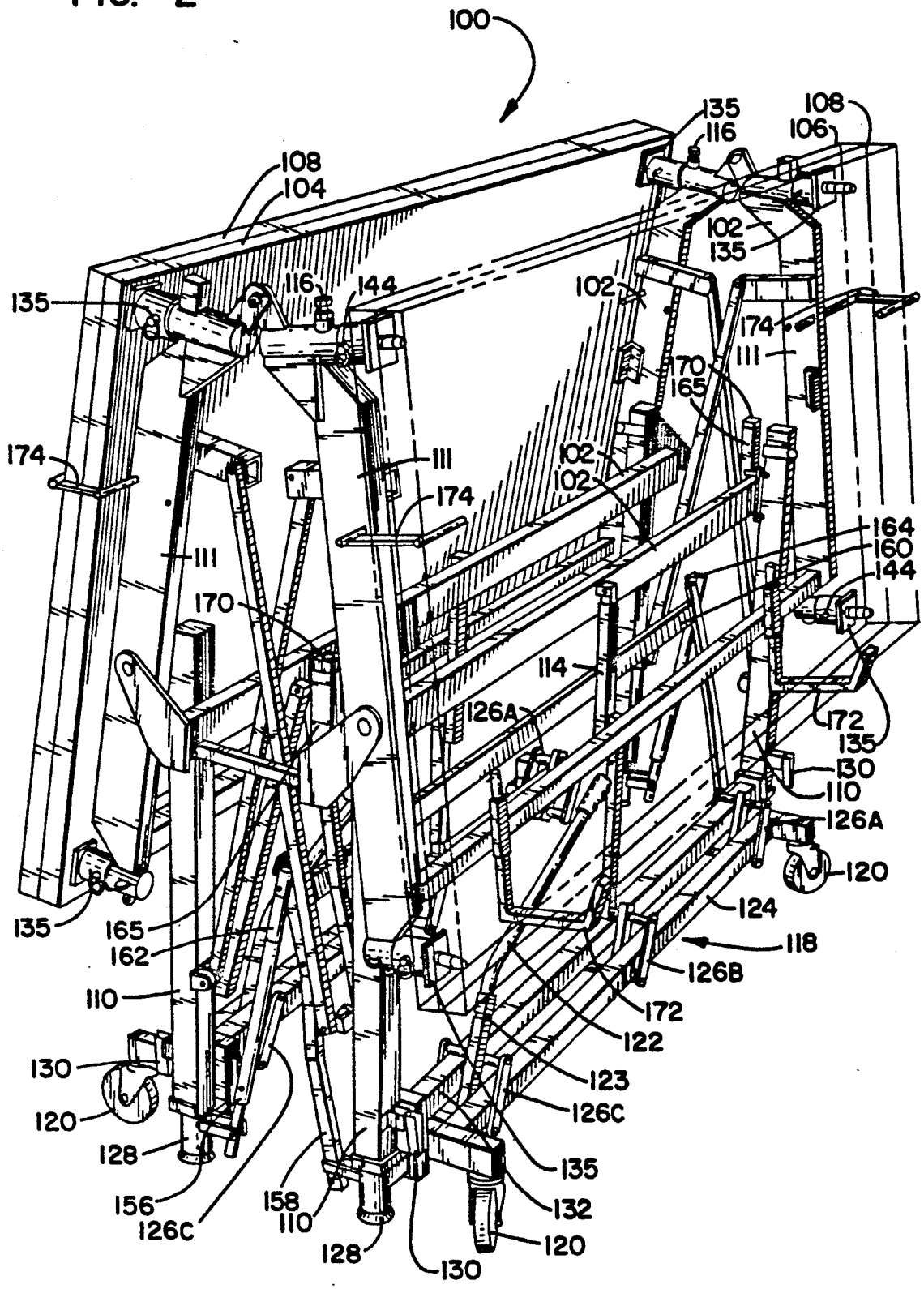
FIG. 2 shows a perspective view of the stage shown in FIG. 1 in a folded storage position and having stage panels stored thereon.

Referring now to the figures, and in particular to FIG. 1, there is shown an elevationally adjustable folding stage 100 in an unfolded, ready-for-use position. The stage supports a pair of panels 104 and 106 on a framework 102. The frame 102 folds to a storage position as shown in FIG. 2 wherein the panels 104 and 106 are substantially facing one another and the overall area taken up by the stage is substantially reduced. The panels 104 and 106 are reversible and may have different surfaces on each face, such as carpet or non-skid surfaces. The framework 102 has a folding portion 111 connecting at a center hinge and a folding linkage 112 which maintain legs 110 substantially upright when in the folded or unfolded position and during folding. The height of the stage can be varied with telescoping members 128 extending from the legs 110 which can be raised or lowered to obtain a desired height of the stage 100 and which are adjusted by releasing height adjustment levers 130. The telescoping legs 128 have pads which engage the floor. Raising and lowering and folding the stage 100 is assisted by gas springs 114 which are sized to the weight of the stage 100. In addition, adjustments can be made so that the panels 104 and 106 align by adjusting bolt 116 at the center of the folding portion of the frame 111.

Figure 4:
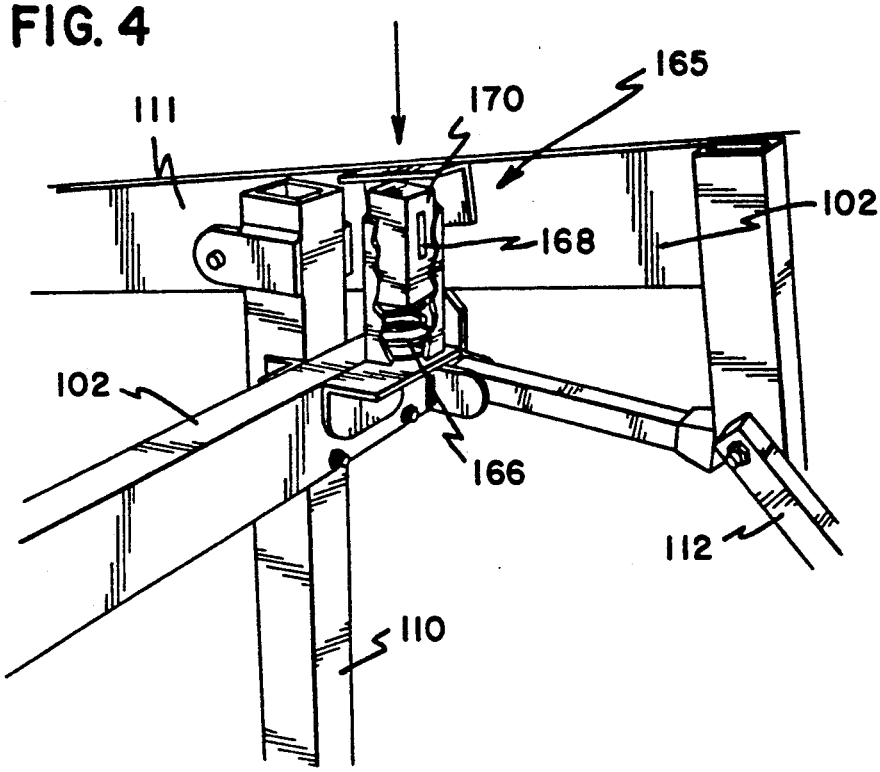
FIG. 4 shows a folding assist apparatus shown in FIG. 3 with the stage in a partially-folded position.
Figure 3:
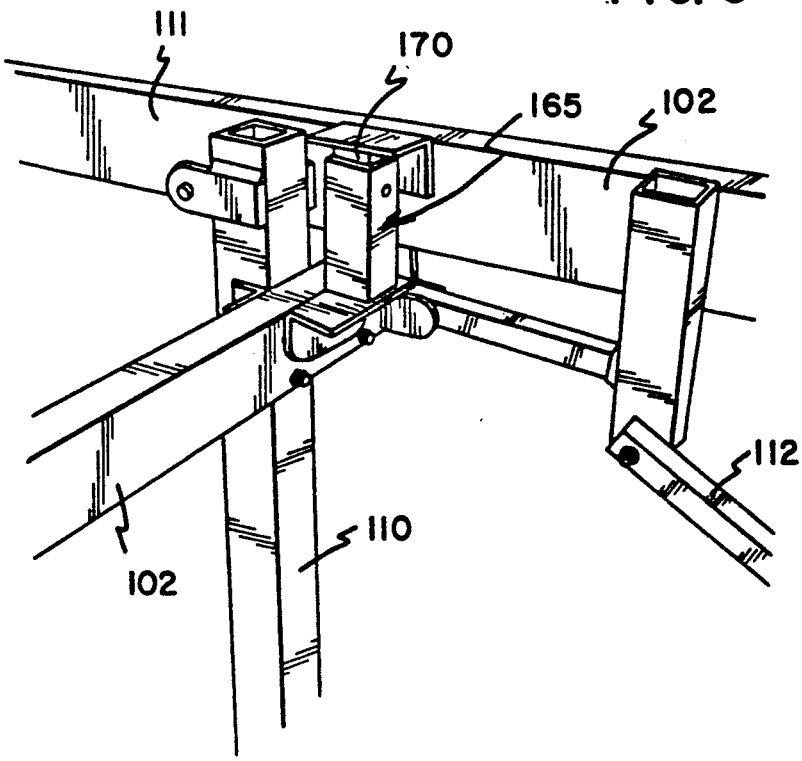
FIG. 3 shows a side partial sectional view of a folding assist apparatus for the stage shown in FIG. 1 with the stage in the fully unfolded position.

As shown in FIGS. 3 and 4, the stage 100 has a folding assist device 165 which aids in the initial folding of the stage from the unfolded position and the final folding of the stage to the folded position. Folding assist device 165 also acts to cushion the frame 100 and panels 104, 106 so that they do not inadvertently fully close, thereby pinching workers' hands or fingers between frame members. A spring 166 supports a floating stanchion 170 which rides in a stationary member of the frame 102. A floating tube portion is guided by a slot 168 in the stationary portion of the frame 102. The floating stanchion 170 supports a member of the folding framework 111. As shown in FIG. 3, when the stage 100 is in the use position, the floating stanchion 170 is fully depressed. The spring 166 exerts a constant pressure on the stanchion 170 against the folding frame member 111 even when the stage is in the fully-unfolded position. Therefore when the initial force is applied to fold the stage 100, the spring 166 pushes the folding frame member 111 toward the folded position. This aids in the initial folding as well as cushioning final folding.

When folding from the fully-folded position to the fully-unfolded position, the folding linkage will unfold until engaging the floating stanchion 170 supported by the spring 166, as shown in FIG. 4. The spring 166 and tube 170 prevent the stage from fully unfolding so that slight pressure, in addition to the weight of the stage, must be applied to fully unfold the stage and depress the floating stanchion 170, as shown in FIG. 3. This provides an added safety feature and eases the labor associated with folding and unfolding the stage 100.

Figure 5:
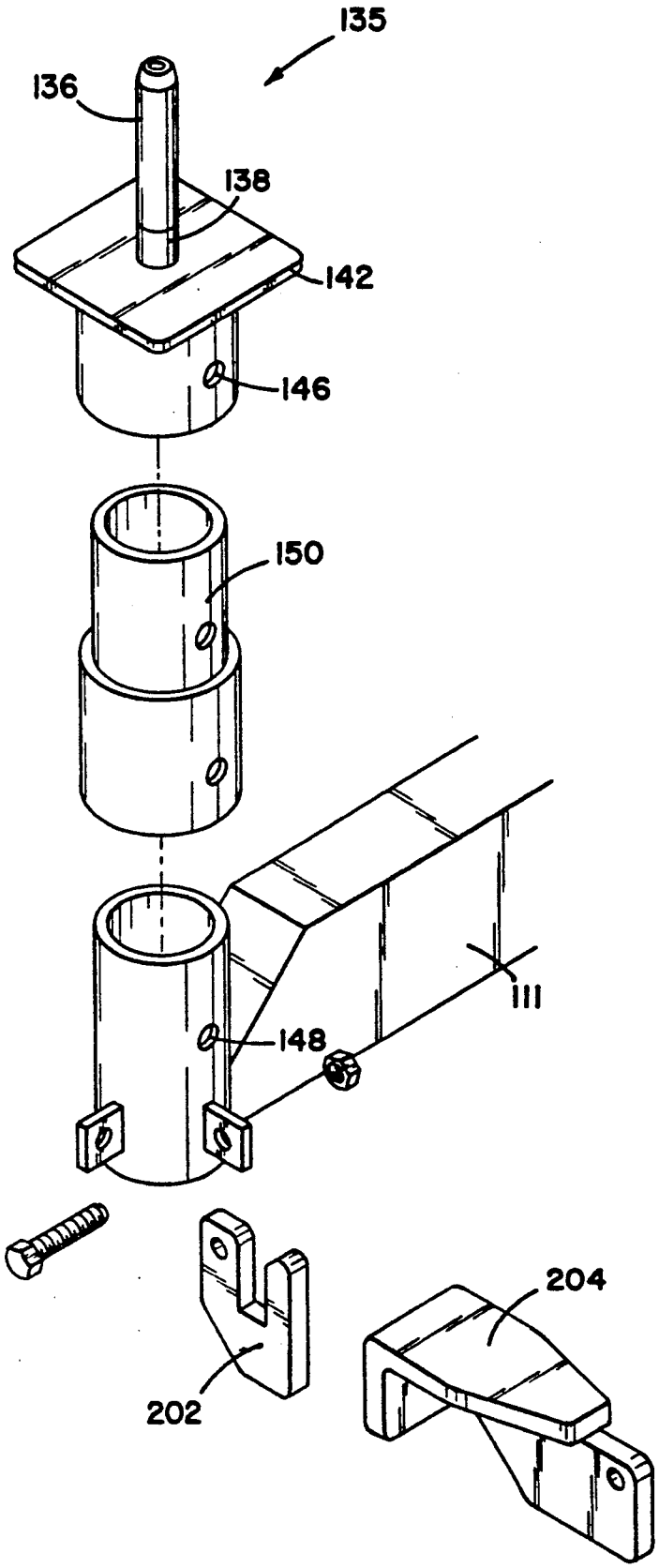
FIG. 5 shows an exploded view of the connector system for attaching the panels to the stage framework and for elevating one panel.
Figure 6:
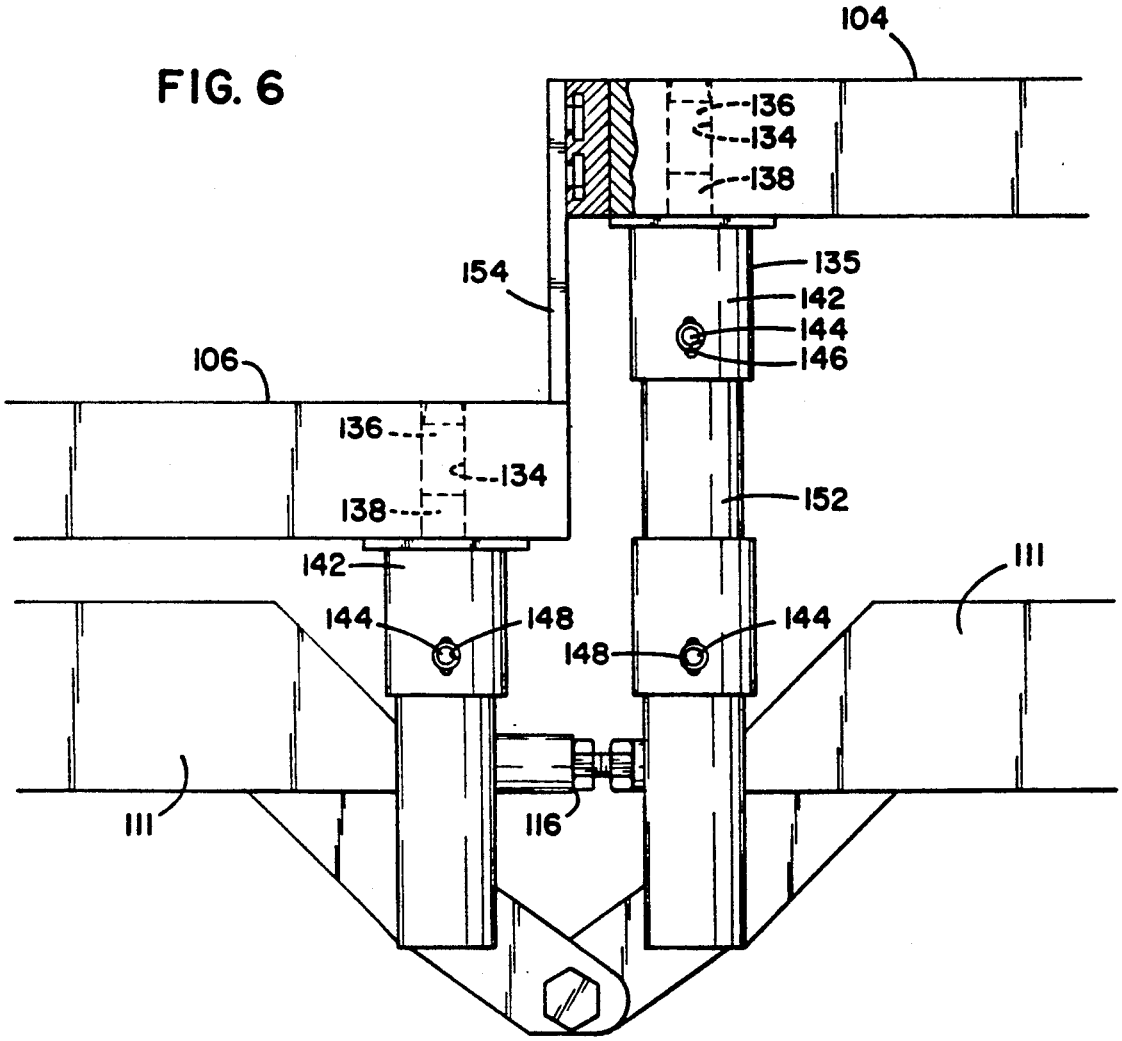
FIG. 6 shows a side view of the stage panels with one panel raised relative to the other panel and with a kickboard in place.

As shown in FIG. 5, the attachments between the frame 102 and the panels 104 and 106 are made with connectors 135 inserting into passages 134 of the panels 104 and 106. The passages 134 are located near each corner of the panels 104 and 106 and extend entirely through the panels 104 and 106. Each connector 135 mounts on support 142 which connects with a cotter pin 144 inserting through holes 146 in each support 142 to holes 148 in the frame 102. To raise one panel 104 relative to the other panel 106, risers 150 and 152 may be placed below the panel. The riser 150 or 152 extends the height of the stage panel without raising both panels 104 and 106. Typically the risers are either four inches or eight inches. When an eight inch riser 152 is inserted, a kickboard 154 is placed between the elevated panel 104 and the lower panel 106 to cover the space as shown in FIG. 6. It can be appreciated that by raising one panel 104 relative to the other panel 106 on the stage, choral riser configurations may be achieved. It can also be appreciated that bridging panels extending between the stages may be raised with the elevated panels 104 to create extended choral risers.

Figure 20:
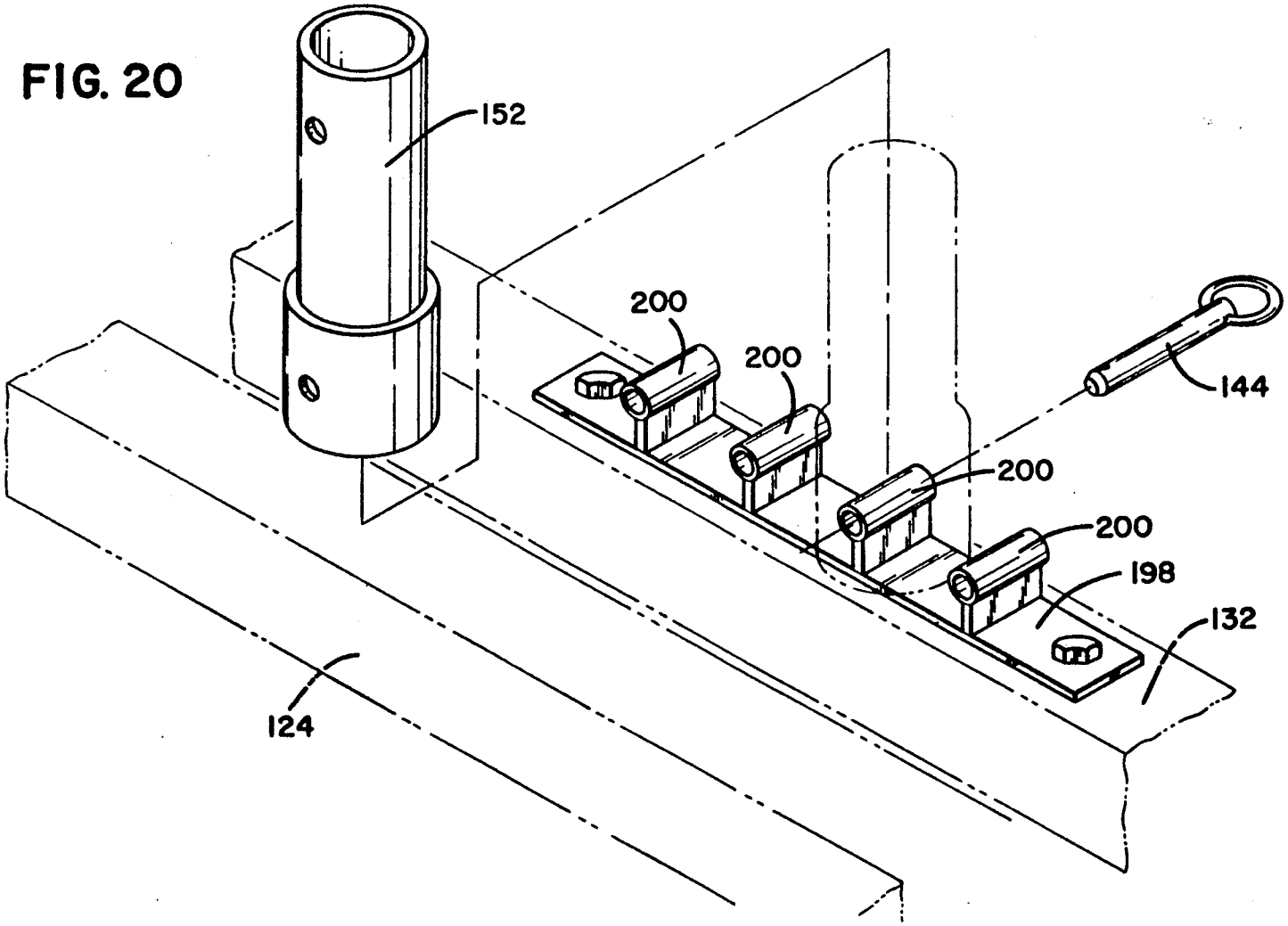
Figure 21:
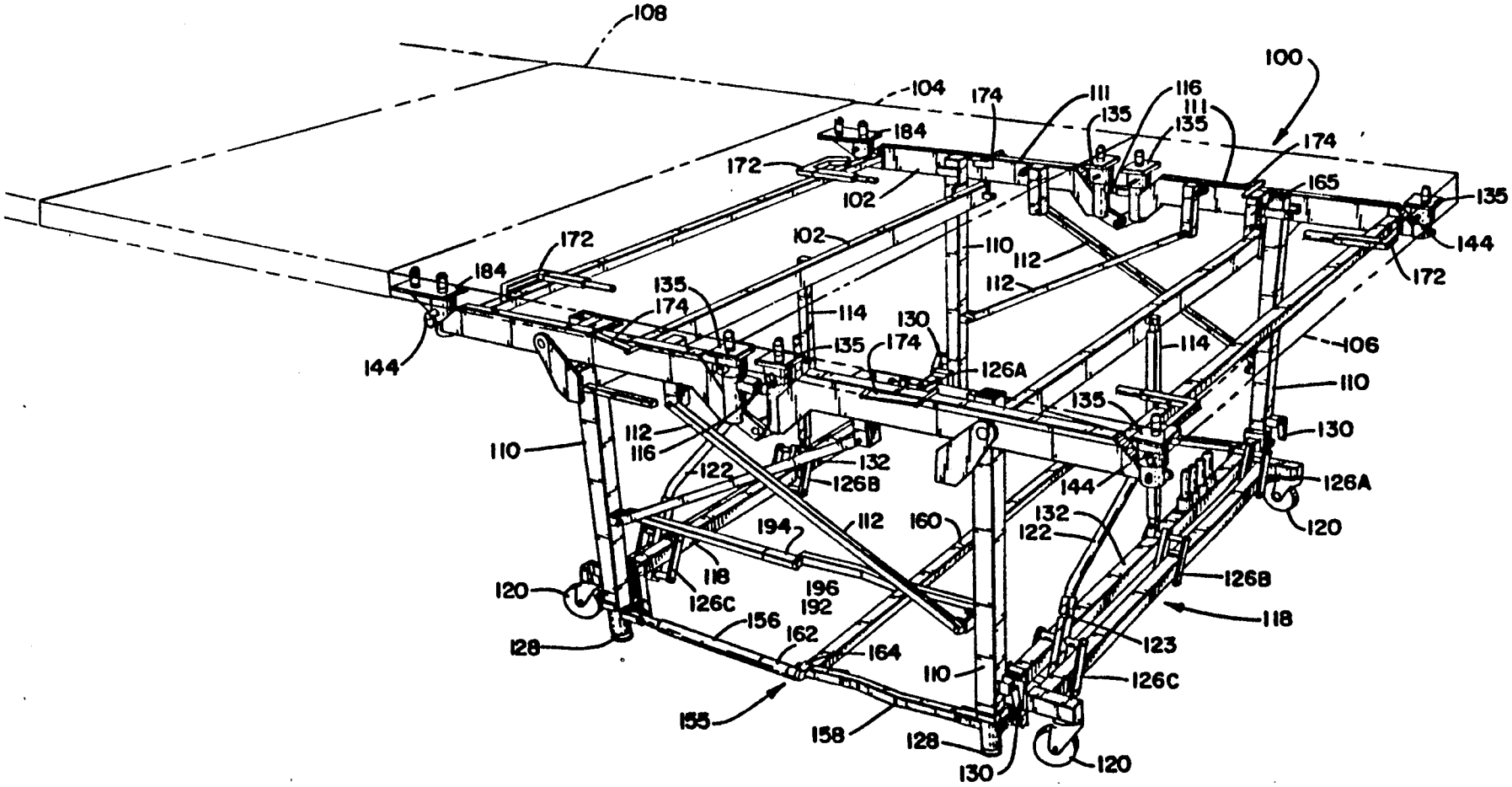
FIG. 21 shows a perspective view of an unfolded stage with bridging panels extended.

As shown in FIG. 20, risers 150 and 152 may be stored on the stage frame 102 when not in use. The risers 150 and 152 mount on storage racks 198 having riser storage members 200 thereon. The risers 150 and 152 slide over the storage members 200. The cotter pins 144 are then slid through the risers and the storage members 200, thereby retaining the risers in an out-of-the-way location.

As shown in FIG. 5, latching members 202 engage complementary latching member 204 for spacing and connecting bridge panels 108. The panels 108 are supported on the stage with connectors, as explained hereinafter.

Figure 7:
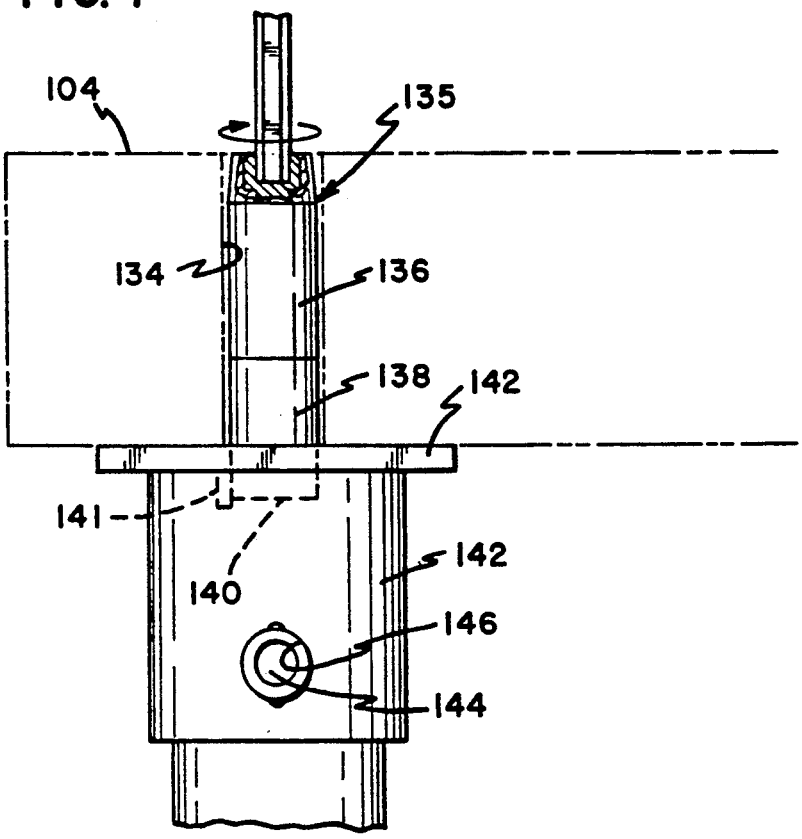
FIG. 7 shows a side sectional view through a stage panel with the connector extending into the panel in the unlocked position.
Figure 8:
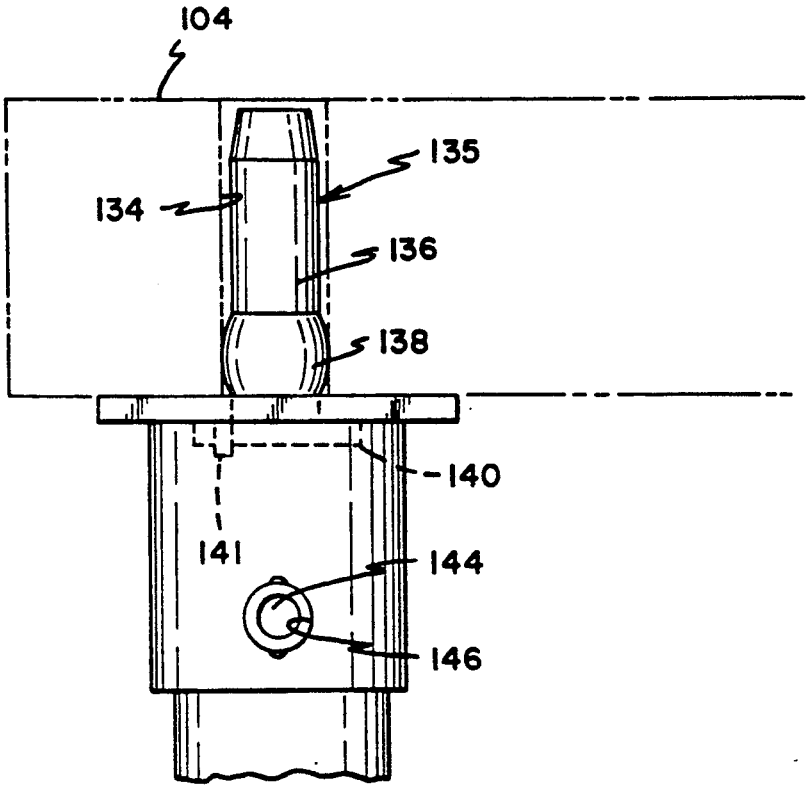
FIG. 8 shows a side sectional view of the connector shown in FIG. 7 with the connector turned into the locked position.

Referring now to FIGS. 7 and 8, the connector 135 extends through the passage 134 of the panels 104 and 106 to be substantially flush with the upper surface of each panel, as shown in FIG. 7. The connector uses a pin 136 extending upward from the support 142 to extend into the passage 134 of the panels. A portion of the pin 136 widens over a flexible compressible portion 138. When the pin 136 is turned and tightened, the compressible portion 138 expands radially as shown in FIG. 8 to engage the walls of the passage 134. This causes frictional engagement between the connector 135 and the passage 134, thereby retaining the panel against the frame 102. The pin 136 is mounted with a flexible base 140 which allows slight movement of the pin 136 for alignment into the passages 134. The flexible base 140 is adjacent a stop plate 141. The base 140 has a length greater than its width so that when the pin 136 is rotated, the base 140 engages the stop plate 141, as shown in FIG. 8, to prevent additional rotation of the pin 136. It can be appreciated that with a standard set screw head on the bolt, standard hex wrenches may be used to tighten the stage panels 104 and 106 to the frame 102. In addition, since the connector 135 is a single piece attached to the frame 102, no extra loose pieces are needed, so that pieces will not be lost when attaching panels to the frame. It can also be appreciated that the connectors 135 provide a substantially flush surface with the panels 104 and 106.

Figure 9:
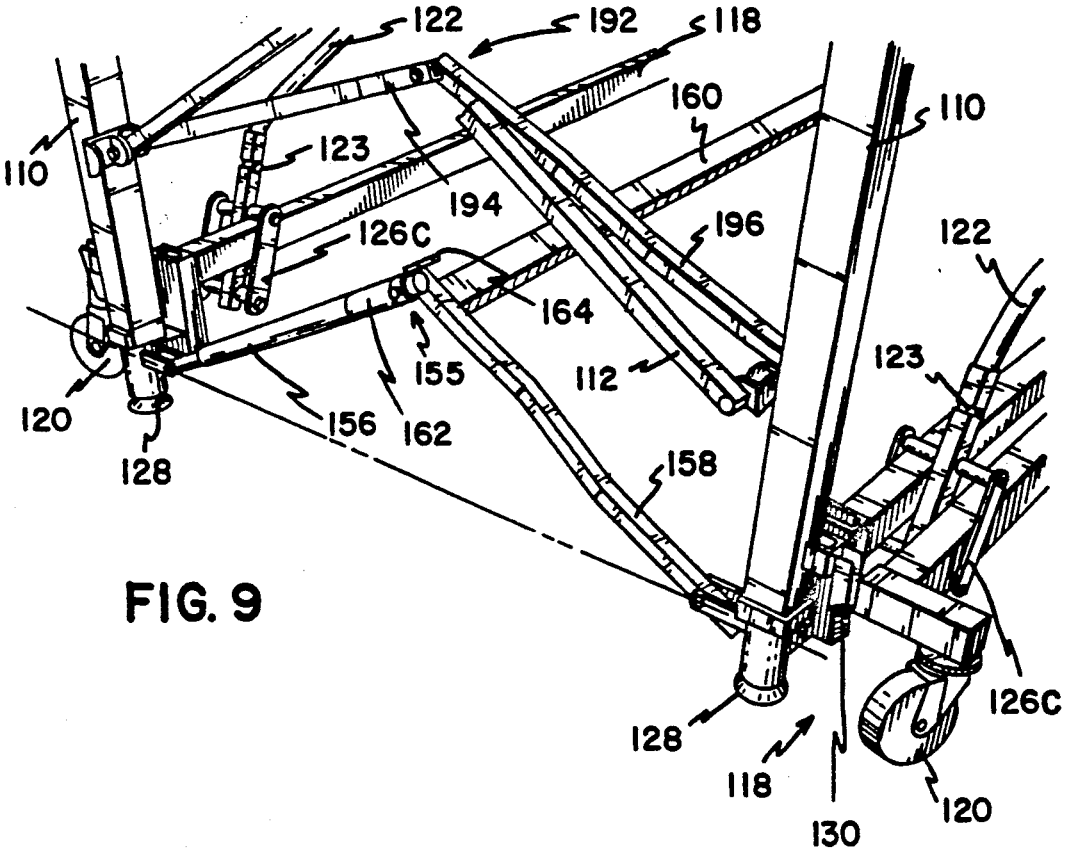
FIG. 9 shows a perspective view of the locking mechanism for the stage shown in FIG. 1 in the partially folded position.
Figure 10:
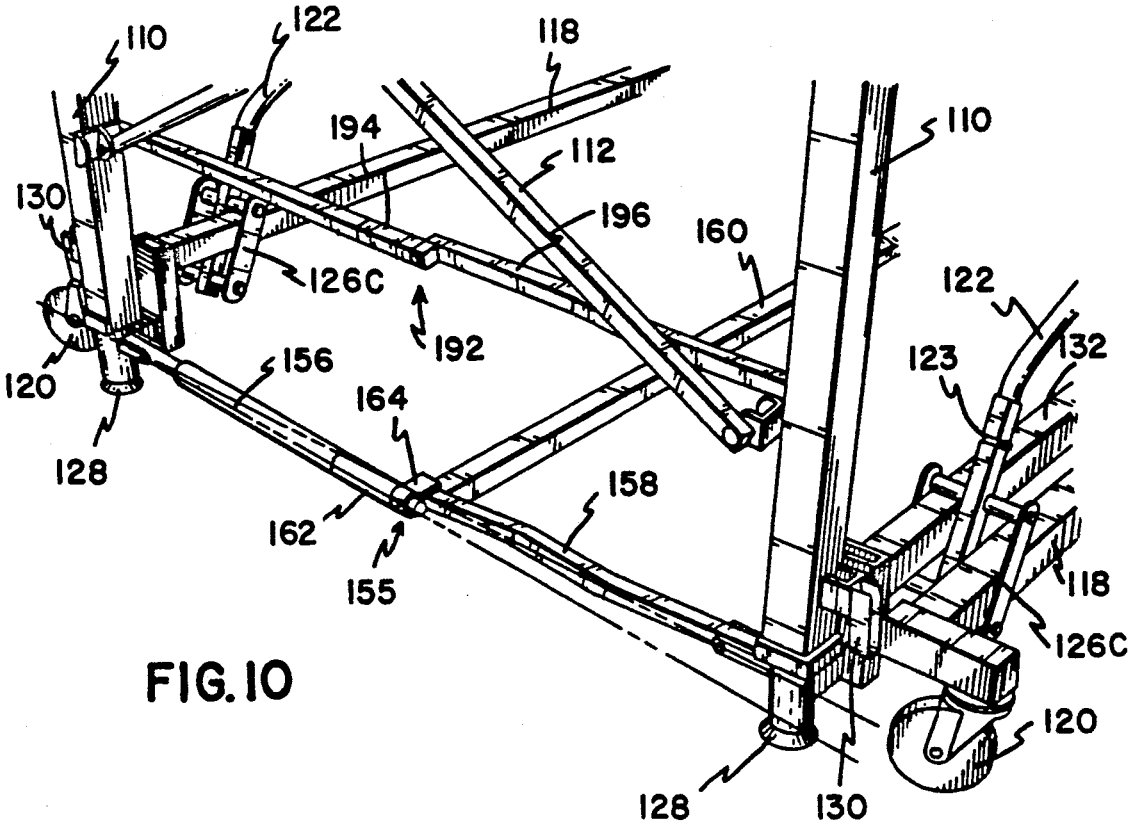
FIG. 10 shows a perspective view of the locking mechanism shown in FIG. 9 with the stage unfolded and the locking mechanism locked.

As shown in FIG. 9, to lock the stage in the fully unfolded position, a locking linkage 155 is provided which locks folding halves of the frame. The locking linkage 155 has a pair of cross links 156 and 158 extending between legs 110 from underneath each panel 104 and 106. Cross link 156 has a handle 162 which provides for lifting and lowering the linkage and a stop 164 for holding the linkage 155 in a locked position. The linkages 155 between the opposing pairs of legs are connected by a member 160 extending along the center of the stage. To lock the stage 100 in the use position, the locking linkage in the position shown in FIG. 10 is pushed downward through the toggle point, shown in phantom. When the linkage 155 is passed through the toggle point, the cross link 158 engages the stop 164, preventing further folding of the linkage. Any inward pressure against the linkage 155 forces the link 158 against the stop 164 so that the stage 100 is prevented from folding.

In addition, a spacing linkage 192 between one pair of legs 110 and above one of the locking linkages 155 is provided to space the legs during height adjustment of the stage 100. The spacing linkage 192 has links 194 and 196 extending between the legs and above the locking linkage 155. The spacing linkage 192 folds with the stage, but acts with the locking linkage 155 to prevent the stage 100 from folding during elevational adjustment.

As shown in FIG. 2, bridging panels 108 may be stored on top of the panels 104 and 106 when the stage 100 is folded. The panels 108 extend the area of the stage surface between stages 100. This provides for an extended continuous stage surface without having a frame below each stage panel. Storage of the bridge panels 108 on folded stages saves on storage space and eliminates additional caddies for transporting the bridging panels 108. By having the panels 108 stored on the stage, they are always within easy reach of their final use position.

Figure 11:
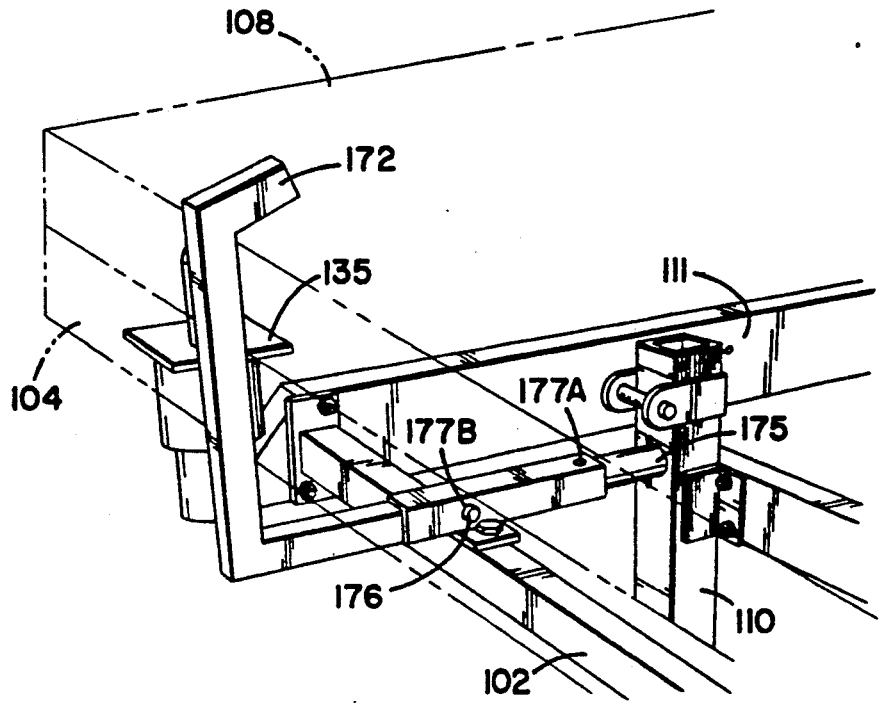
FIG. 11 shows a perspective view of a lower retaining member in the retaining position for retaining stored panels on the stage.

The bridge panels 108 are retained on the stage 100 by hook members 172 along the lower edge of the panels and hook members 174 near the upper portion of the panels. As shown in FIG. 11, the lower hook members 172 extend beyond the edge of panel 104 or 106 and the bridging panel 108. The hook extends above the upper surface of the base of the stage panels and supports the lower edges of the stage panels as well.

Figure 12:
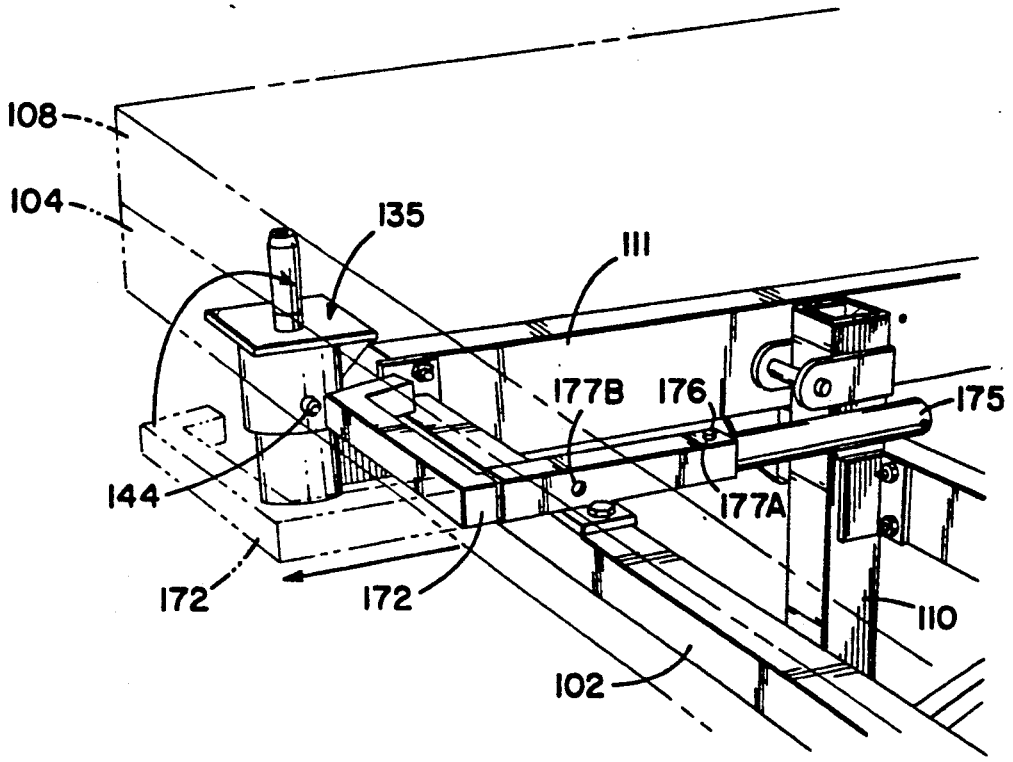
FIG. 12 shows the retaining member shown in FIG. 11 with the retaining member in the non-retaining retracted position.

As shown in FIG. 12, the lower hook members rotate about a shaft portion 175 to the side and then slide under the panels 104 and 106 when the retaining hook members are not being used. The hook members 172 are kept in either the storage or in position by engaging or disengaging a spring-loaded release button 176. The release button 176 extends through holes 177*a* and 177*b* in a mounting member to retain the hook members in hidden or use positions. The hole 177*a* is slightly smaller than the button 176 so that it is slightly depressed even when aligned with the hole 177*a*, thereby providing some resistance to rotating, but not locking the members 172 in the hidden position. The release button 176 does fit into hole 177*b* so that it must be manually depressed to rotate the hook members 172 from the panel-retaining position.

Figure 13:
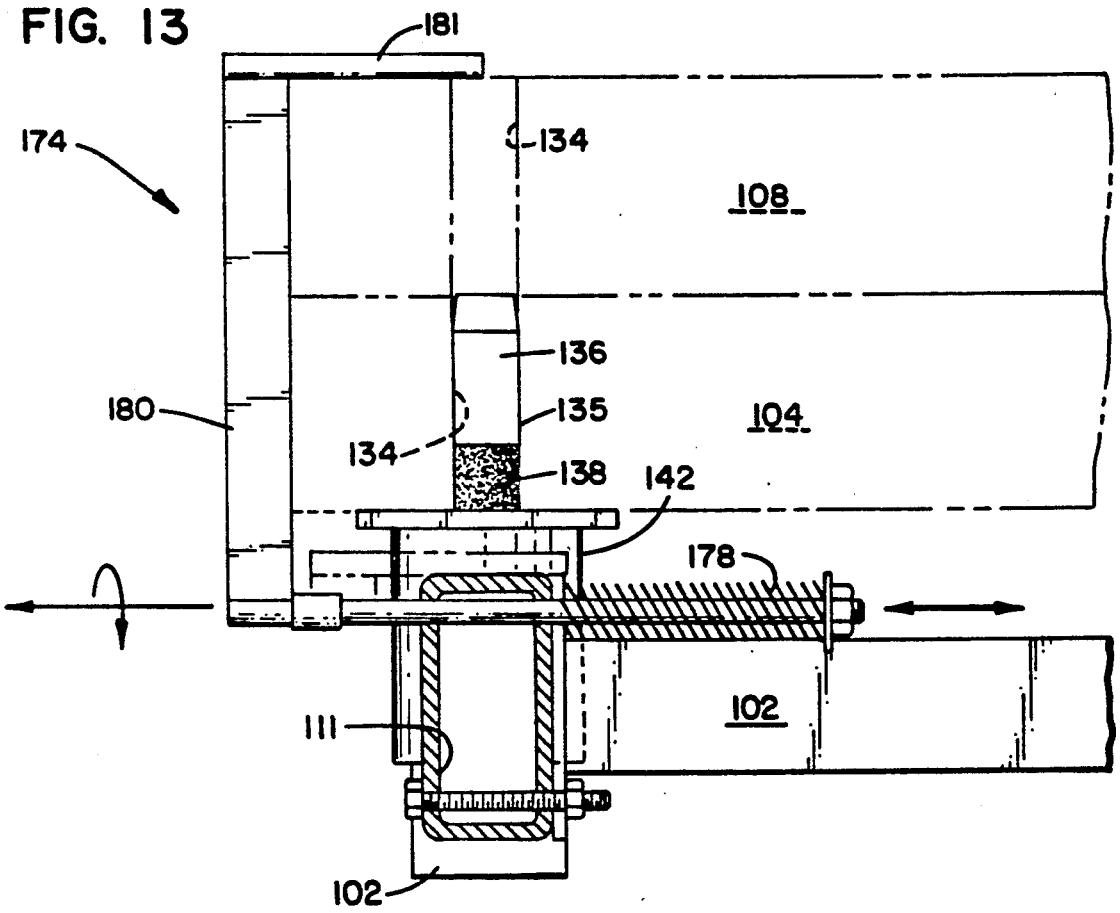
FIG. 13 shows a side view of an upper retaining member for retaining the panels stored on the stage and a portion of the panel with the retaining member in the retaining position.

As shown in FIG. 13, the upper members 174 mount on the folding frame 111 and are spring-loaded so that each member 174 is held tightly against the folding frame 111. A spring 178 forces the hook member 174 toward the frame 102, shown in FIG. 2, so that an upper portion 181 of the hook members 174 rests between the panels 104, 106 and the folding frame 111 during storage. When in use, a handle portion 180 is grasped and the members are pulled away from the frame and lifted outward and upward. The upper portion 181 of the hook member 174 then is placed above the bridge panel 108 and the spring 178 pulls the upper portion 181 of the hook member over the panel 108.

The hook members 172 and 174 provide for storing the bridging panels 108 without requiring additional tools or loose extra pieces which are not connected to the stage 100.

Figure 14:
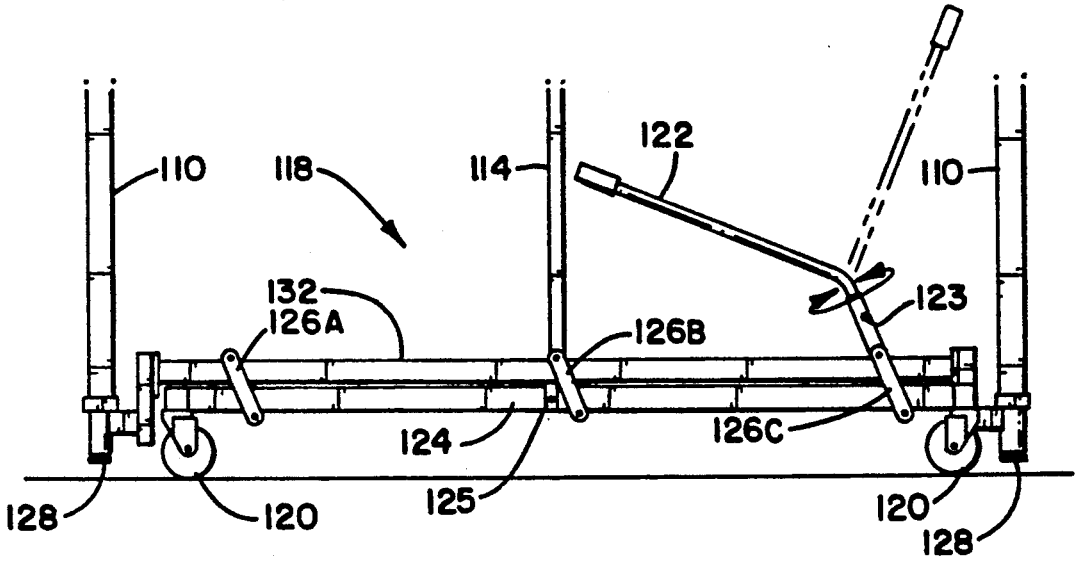
FIG. 14 shows a side view of the roller assembly for the folding stage shown in FIG. 1 with the rollers fully lowered and engaging the ground.
Figure 15:
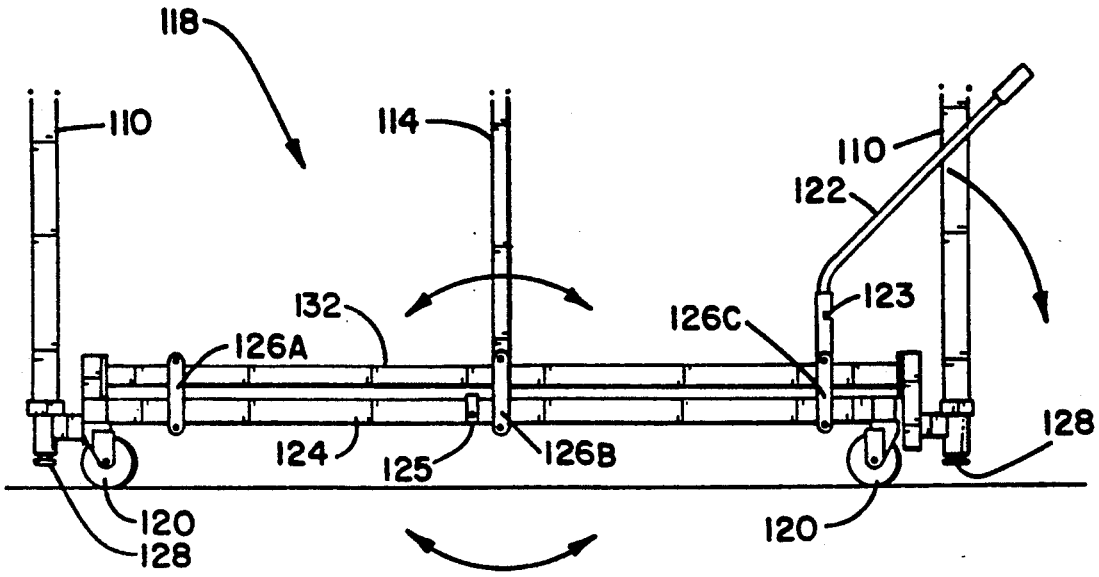
FIG. 15 shows a side view of the roller assembly shown in FIG. 14 partially retracted with the rollers engaging the ground.
Figure 16:
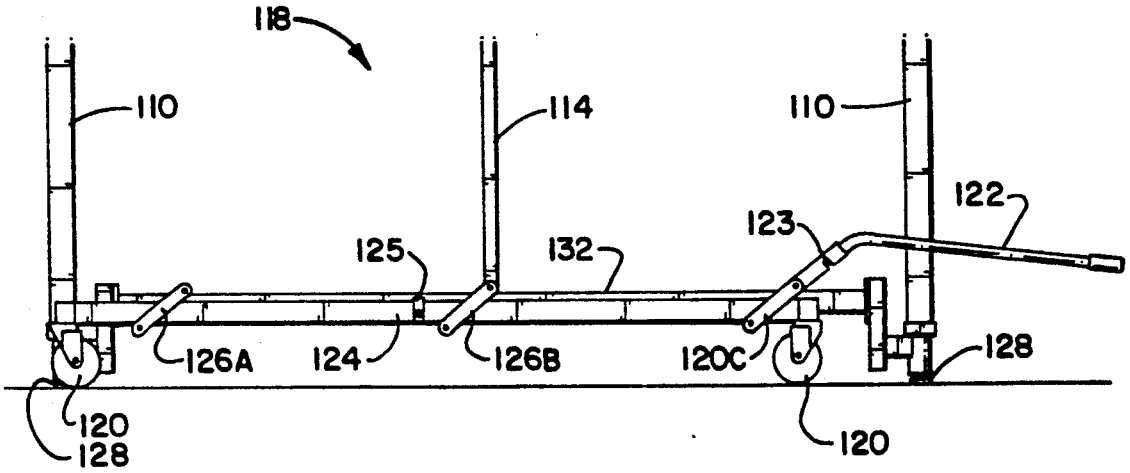
FIG. 16 shows the roller assembly shown in FIG. 14 with the rollers fully raised and the legs engaging the ground.

As shown in FIGS. 14–16, the stage 100 has roller assemblies 118 which can be used to roll the stage between use and storage locations. The roller assembly 118 raises and lowers the stage so that the legs 110 engage or disengage the ground. As shown in FIG. 14, when the roller assembly 118 is fully lowered, rollers 120 engage the floor and the legs 110 are fully raised from the floor so that the stage 100 rolls to various locations. When the roller assembly 118 is lowered, the stage 100 may be rolled in either the folded or unfolded position. When the roller assembly 118 is raised as shown in FIG. 16, the legs 110 engage the ground and the rollers 120 do not support any weight of the stage so that the stage cannot move from the use position.

In order to raise and lower the roller assembly 118, a handle 122 attaches thereto. The handle 122 can be rotated between a storage position for storage and a use position to provide maximum mechanical advantage. The rotation of the handle 122 is limited by a slot 123 on a handle receiving portion of mounting beam 124. The mounting beam 124 has rollers 120 mounted thereon and rises and falls along with the rollers 120. The mounting beam connects to a beam 132 of the frame by links 126A, B and C. Upon actuating the handle 122, the roller assembly 118 is pivoted from the raised position as shown in FIG. 16 through the position shown in FIG. 15 wherein both the rollers 120 and legs 110 engage the ground to the fully-lowered position as shown in FIG. 14, wherein the rollers 120 engage the ground and lift the legs 110 off the ground. The links 126 pivot the beam 124 up and down relative to the frame 102 and maintain the rollers 120 parallel to the ground. Center link 126B engages a stop 125 on the beam 132 of the frame to prevent further pivoting of the links 126 and maintain the rollers 120 in a fully-lowered position. In addition, the handle 122 is elevated and near the panels 104 and 106 and provides for raising and lowering the stage 100 without reaching down to near the floor level as had been required with prior roller assemblies for stages.

Figure 17:
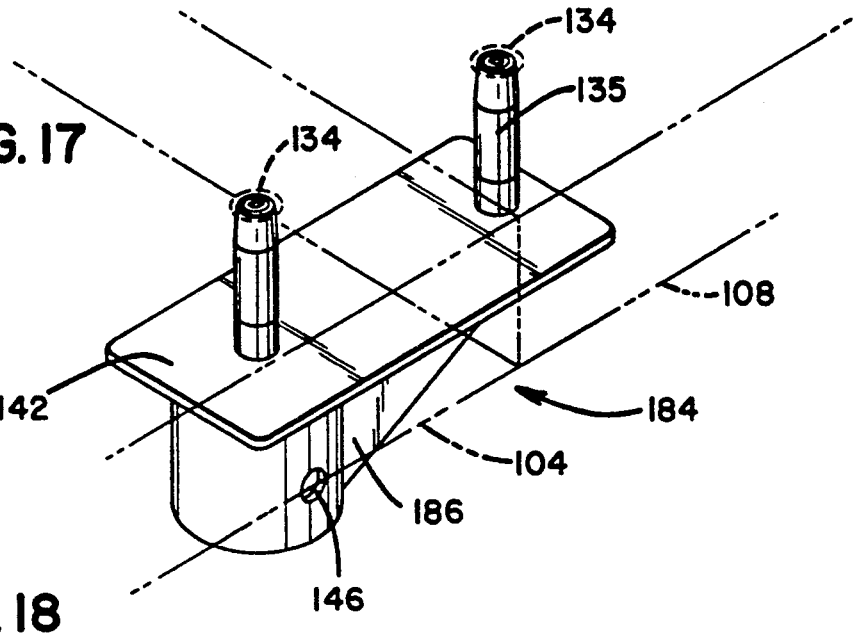
FIG. 17 shows a perspective view of a bridging device for supporting an adjacent panel.

As shown in FIG. 17, to support the bridging panels 108 between stages, a bridging support 184 is implemented. The support 184 includes a connector 185 placed on the frame of folding or other stage in the same position as a single support 142. The two-way support 184 includes a gusset 186 for additional strength which supports the second connector 135 which inserts into a bridging panel 108.

Figure 18:
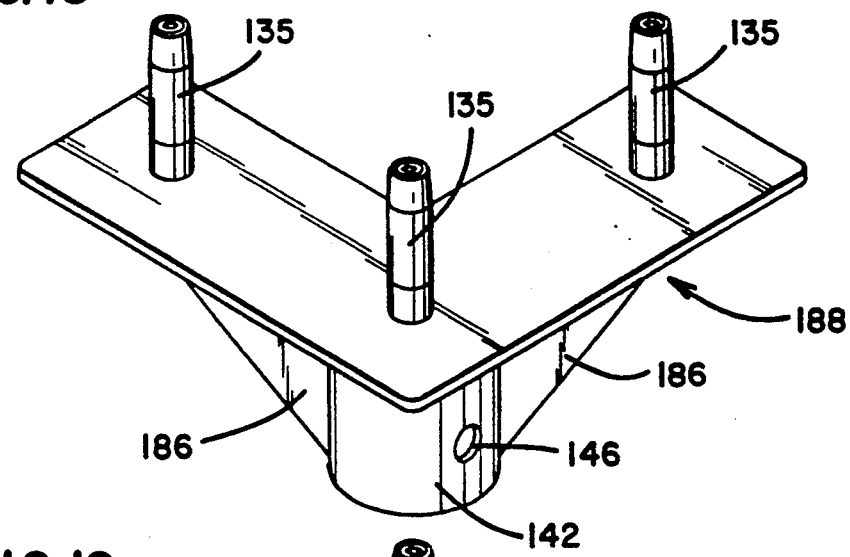
FIG. 18 shows a perspective view of a bridging device supporting an adjacent panel on two sides of the stage.

In addition to supporting a single bridging panel 108 off one side of a stage, panels 108 may be supported off two sides of the some stages with a three-way support 188, shown in FIG. 18. As with the two-way support, the three-way support attaches to the stage frame in the same position as the single support 142. The three-way support includes a connector for the stage as well as connectors 135 for each of the bridging panels.

Figure 19:
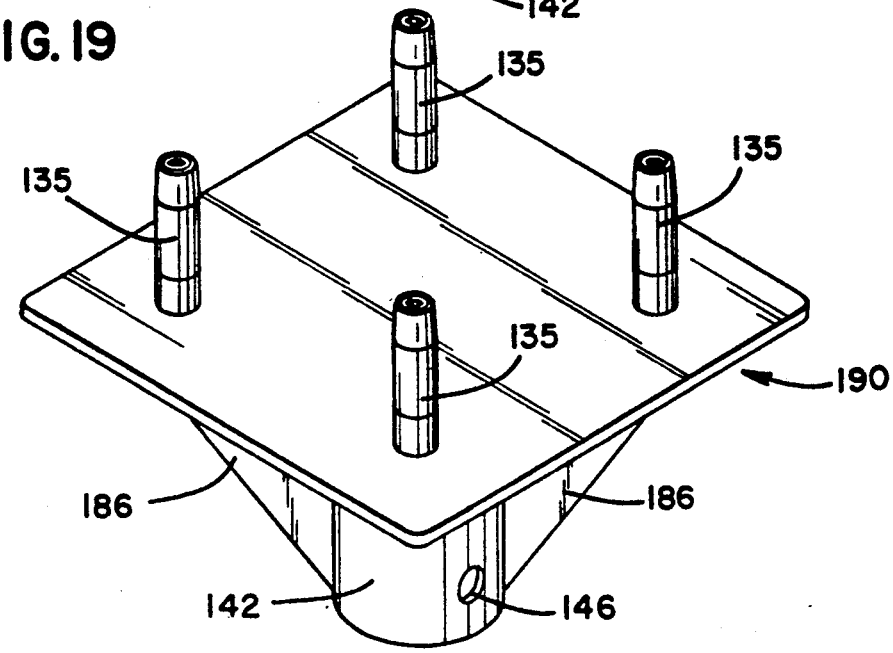
FIG. 19 shows a four-way bridging device for supporting three panels adjacent the stage at a corner; and, FIG. 20 shows a storage rack on the frame of the stage for storing height extending risers.

As shown in FIG. 19, bridging panels 108 may be supported from stages off both sides and also between the bridging panels extending off both sides for an even larger extended stage surface. In order to support the three additional bridging panels 108, a four-way support 190 is implemented which attaches in the same manner as the single, double and triple supports.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A folding stage, comprising:

a pair of adjacent stage panels forming a stage surface;

a folding framework, folding from a use position wherein the stage panels form a stage surface, to a storage position wherein the stage panels substantially oppose one another;

detachable bridging panels having a first end mounting to the folding stage and extending from the folding stage for forming an extended stage surface;

support legs supporting the framework;

means for supporting detachable bridging panels from the stage; and, means for retaining the detachable bridging panels adjacent an outer surface of the stage panels in the folded storage position.

2. A folding stage comprising:

a pair of adjacent stage panels forming a stage surface;

a folding framework, folding from a use position wherein the stage panels form a stage surface, to a storage position wherein the panels substantially oppose one another;

support legs supporting the framework;

bridging panels having a first end mounting to the folding stage and extending from the stage for forming an extended stage surface;

means for supporting the first end of the bridging panels from the stage; and, hook members mounting on the framework and swinging up to a retaining position for retaining a stage panel and a bridging panel when the stage is in the storage position.

3. A folding stage according to claim 2, wherein the hook members swing below the stage panels when the stage is in the use position.

4. A folding stage according to claim 3, wherein the retaining means comprise hook members along a lower edge of the panels and hook members along the sides of the panels.

5. A folding stage according to claim 2, wherein the hook members further comprise handles for actuating the hook members between a storage position and a retaining position.

6. A folding stage according to claim 3, further

7. A folding stage according to claim 1, wherein the retaining means are mounted on the stage.

8. A folding stage according to claim 7, wherein the retaining means are retractable.

9. A folding stage, comprising:

a pair of adjacent stage panels forming an extended stage surface;

a framework, folding from a use position wherein the stage panels form a stage surface to a storage position wherein the panels substantially oppose one another;

supporting legs including first and second legs supporting a first stage panel and opposed first and second legs supporting a second stage panel, corresponding to the first and second legs supporting the first storage panel;

locking means for locking the stage in the use position, comprising a linkage extending between the first legs of the first and second stage panels, the linkage having a first linkage member coupled to the first leg of the first stage panel and a second linkage member coupled to the opposed first leg of the second stage panel, wherein the first and second linkage members are pivotally connected, and restraining means for preventing movement of the linkage past a predetermined position, wherein the linkage passes through a toggle point whereat the first and second linkage members are colinear so that the linkage members engage the restraining means and snap through the toggle point into locked engagement at the predetermined position.

10. A folding stage according to claim 9, further comprising a spacing linkage between the opposed legs of each panel.

11. A folding stage according to claim 9, further comprising an actuating handle attached to one of the linkage members for urging the linkage through the toggle point.

12. A folding stage according to claim 9, wherein a pair of linkages extending between two sets of opposed legs are connected by a cross member extending between the linkages.

13. A folding stage according to claim 9, wherein the restraining means comprises a stop extending from the first linkage member and engaging the second linkage member upon the linkage passing through the toggle point.

14. A folding stage, comprising:

first and second adjacent stage panels forming a stage surface;

detachable spare panels;

a framework, folding from a use position wherein the stage panels form a stage surface to a storage position wherein the panels substantially oppose one another;

supporting legs; and, removable spacers of various heights insertable between the framework and the stage panels for raising the elevation of the first stage panel relative to the second stage panel means for retaining the detachable spare panels against the stage panels in the folded storage position.

15. A folding stage according to claim 14, further comprising a kick panel covering the opening between the first panel when elevated and the second panel.

16. A folding stage according to claim 14, wherein either stage panel may be elevated relative to the other panel.

17. A folding stage for storing detachable spare panels, comprising:

a pair of adjacent stage panels forming a stage surface;

a folding framework, folding from a use position wherein the stage panels form a stage surface, to a storage position wherein the stage panels substantially oppose one another;

support legs supporting the framework; and means for retaining the detachable spare panels against the stage panels in the folded storage position.

18. A stage according to claim 17, wherein the spare panel retaining means comprise hook members mounting on the framework and swinging up to a retaining position for retaining a spare panel against a stage panel.

* * * * *